United States Patent [19]

Cassidy

[11] 4,024,956

[45] May 24, 1977

[54] METHOD AND APPARATUS FOR DETECTING LEAKS

[75] Inventor: Bruce P. Cassidy, Richmond, Va.

[73] Assignee: American Brands, Inc., New York, N.Y.

[22] Filed: Nov. 20, 1975

[21] Appl. No.: 633,984

[52] U.S. Cl. ..... 209/73; 209/79; 53/53; 73/52

[51] Int. Cl.[2] ..... B07C 1/10

[58] Field of Search ..... 209/73, 74, 88, 79; 53/53; 73/52

[56] References Cited

UNITED STATES PATENTS

| | | | |
|---|---|---|---|
| 3,319,784 | 5/1967 | Granger | 209/79 X |
| 3,396,842 | 8/1968 | Bowen et al. | 209/73 |
| 3,590,550 | 7/1971 | Gianese | 209/79 |
| 3,606,014 | 9/1971 | Linn | 209/79 |

*Primary Examiner*—Allen N. Knowles

[57] ABSTRACT

A method and apparatus particularly adapted for use in continuously testing for leaks in a plurality of generally fluid-tight and flexible packages which are conveyed along a predetermined path. This particular apparatus embodies first means for selectively and continuously conveying a plurality of the packages along the predetermined path, second means operatively connected to the first means for compressing the generally fluid-tight packages as they are continuously conveyed along the predetermined path to the extent that those packages which do not have leaks expand by at least a predetermined amount and whereas those packages which have leaks will not expand by the predetermined amount, and third means being operatively connected to the second means for at least monitoring the existence of the predetermined expanded packages as the packages are continuously advanced to thereby enable defective packages to be eliminated. The method comprises the steps of continuously advancing a plurality of generally fluid-tight and flexible packages along a predetermined path, compressing the packages as they are successively advanced along the predetermined path such that those packages which do not have leaks expand by at least a predetermined amount and whereas those packages which have leaks will not expand by the predetermined amount, and monitoring the packages to determine which packages do not have leaks so as to enable removal of the defective or leaking packages.

15 Claims, 7 Drawing Figures

METHOD AND APPARATUS FOR DETECTING LEAKS

BACKGROUND OF THE INVENTION

1. Field of the Invention

The present invention is generally directed to the continuous testing of sealed, generally fluid-tight and flexible packages to determine whether or not such packages or seals thereof have defects, such as air leaks and the like. More specifically, it pertains to a novel and improved leak detecting method and apparatus which facilitates the rapid and accurate in-line leak testing of a plurality of continuously conveyed generally fluid-tight packages in a simple but yet reliable manner without destruction to the package or the contents in the package.

2. Brief Description of the Prior Art

In general, it is a rather conventional industrial practice to test sealed and enclosed packages, containers, or the like, in order to determine whether or not such packages or containers have defects such as leaks that might otherwise result in damage or loss of the contents within the package. Should the package possess leaks they, of course, fail to adequately perform their intended function. In production line testing for leaks in sealed and generally fluid-tight packages, especially packages fabricated from a relatively flexible material, it is highly desirable that such testing be performed in a continuous manner which is not only dependable and provides economic savings in time, labor and costs, but one which does not otherwise damage the package or the contents within the package during the testing operation.

In the packaging field, there are several known types of mechanisms and methods which enable the testing of sealed and generally fluid-tight packages, containers, and the like. One such known leak detecting device, such as basically described in U.S. Pat. No. 3,396,842, essentially discloses an arrangement wherein the containers to be tested are conveyed along a path and a relatively heavy testing wheel serves to compress each of the containers passing thereunder to determine whether or not the container is properly pressurized. If a container has a leak or is not properly filled, it will be somewhat crushed under the load imposed by the testing wheel. Quite obviously, the foregoing described apparatus would not be particularly suitable in those circumstances, wherein relatively thin-walled, flexible containers housing somewhat easily damageable contents are to be tested. This is by virtue of the fact that a rather heavy testing wheel or the like would tend to crush each package as well as the contents thereof. Of course, such a testing technique would be especially unsuitable in situations wherein cigarette packages and the like are to be selectively tested for the presence of leaks in the package or seals thereof.

Other known approaches for use in detecting leaks in packages, especially fluid-tight packages, are essentially directed to arrangements which determine whether or not vacuum conditions in such packages have been lost. These known techniques, likewise as with the previously mentioned apparatus, are basically unsuitable for enabling the continuous, rapid, and accurate testing of packages. This is by reason of the fact that, in normal practice, the packages are placed within an evacuated chamber or the like and subjected to predetermined pressure conditions for a certain time interval. Consequently, it will be readily evident that such prior art techniques suffer from the shortcoming of having a continuous advancement of packages interrupted for the purposes of actually testing the package or the like. Accordingly, these types of prior art devices fail to provide suitable arrangements which enable the rapid and continuous leak detecting of a plurality of containers as such are continuously and successively advanced along a predetermined path.

Another known prior art approach for testing for leaks and the like basically operates on the traced gas principle, wherein sealed and enclosed packages and the like are compressed or otherwise pressurized so that should a leak exist it would be ascertained through the monitoring of the leaked trace gas. Such approach is similarly subject to the shortcoming of having the test conducted while the package is stationary and not continuously advancing.

As can be fully appreciated from the foregoing comments, known prior art apparatuses suffer from certain disadvantages in that they are not particularly adapted for use in rapidly and accurate testing for leaks on a production line basis, such that the packages to be tested are continuously advanced along a predetermined path without their advancement being subject to interruption, and in a manner whereby neither the package nor the contents of either the good or defective packages would be destroyed or otherwise adversely damaged. Additionally, such heretofore known prior art constructions have essentially failed to provide a production line testing and sorting apparatus of the above category which would enable the achievement of the foregoing in a simple fashion but yet in a highly reliable manner.

Accordingly, therefore, it is an object of the present invention to overcome the aforementioned disadvantages normally associated with conventional types of known prior art leak detecting methods and apparatuses.

SUMMARY OF THE INVENTION

Briefly, in accordance with the present invention, there is described a novel and improved leak detecting apparatus which embodies first means for selectively and continuously conveying a plurality of the packages along a predetermined path, second means operatively connected to the first means for compressing the generally fluid-tight packages as they are continuously conveyed along the predetermined path to the extent that those packages which do not have leaks expand by at least a predetermined amount and whereas those packages which have leaks will not expand by the predetermined amount, and third means being operatively connected to the second means for at least monitoring the existence of the predetermined expanded packages as the packages are continuously advanced to thereby enable defective packages to be eliminated. In a preferred embodiment, the third means automatically detects and sorts the good packages from the defective packages by removing the defective packages from the first predetermined path.

The method of this invention basically comprises the steps of continuously advancing a plurality of generally fluid-tight and flexible packages along a predetermined path, compressing the packages as they are successively advanced along the predetermined path such that those packages which do not have leaks expand by at least a predetermined amount and in a predetermined direction, and whereas those packages which have leaks will not expand by the predetermined amount, and monitoring the packages to determine at least which packages do not have leaks so as to enable removal of the defective packages.

BRIEF DESCRIPTION OF THE DRAWINGS

The above, as well as other objects, features, and advantages of the novel and improved in-line leak detecting apparatus of the present invention will become evident upon a reading of a detailed description of such apparatus which embodies the principles of the present invention when viewed in conjunction with the accompanying drawings wherein like reference numerals indicate like structure throughout the several views.

DETAILED DESCRIPTION

Figure 1:
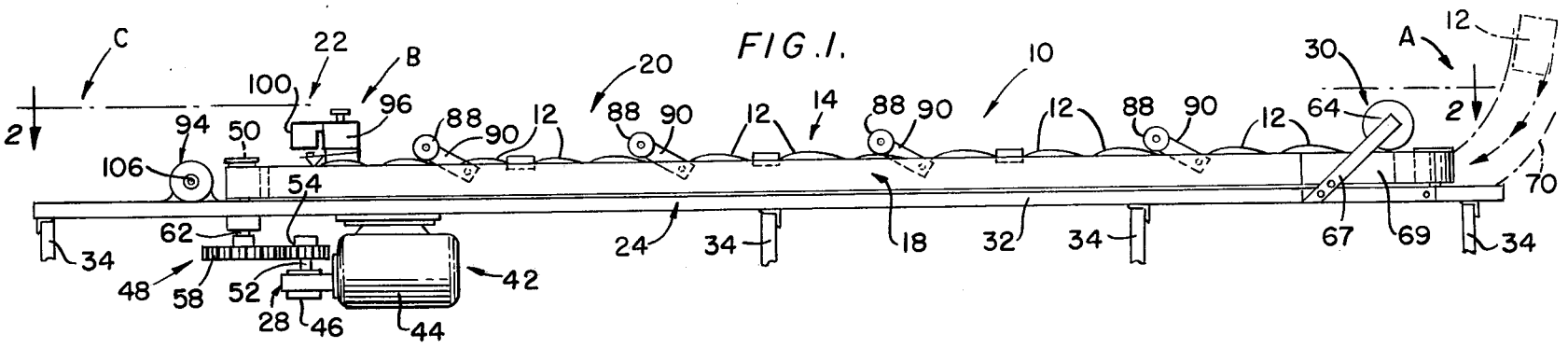
FIG. 1 is a side elevational view illustrating the in-line leak detecting apparatus of the present invention.
Figure 2:
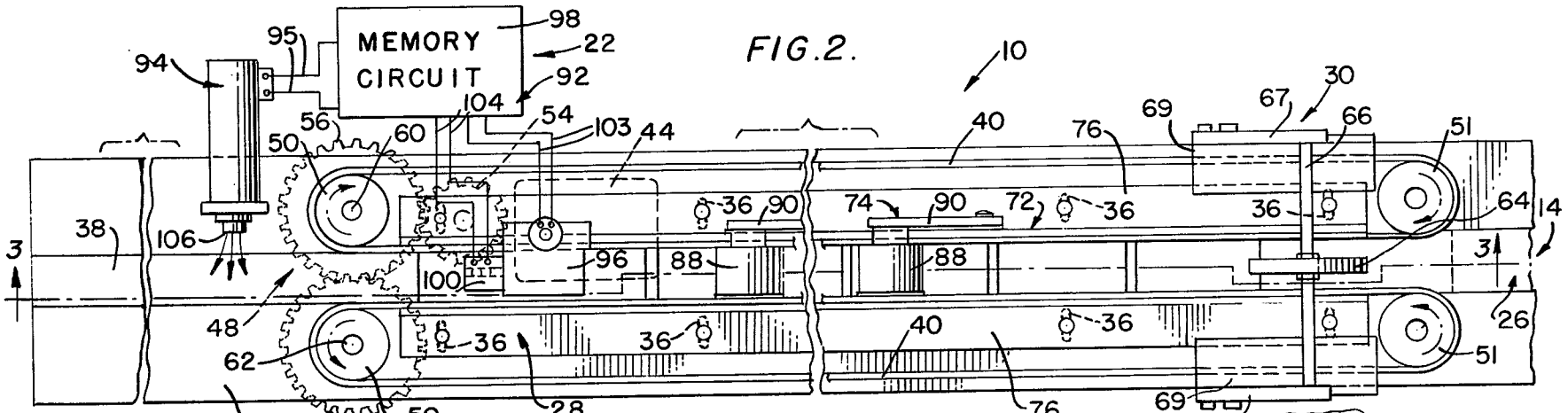
FIG. 2 is a plan view taken substantially along the line 2—2 appearing in FIG. 1 looking in the direction of the arrows and illustrating in even greater detail the in-line detecting apparatus of the present invention, as well as a schematic presentation of the manner by which the monitoring means is associated with the apparatus.

Referring to the drawing and, in particular, to FIGS. 1 and 2 thereof, there is perhaps best depicted a novel and improved in-line leak detecting apparatus embodying the principles of the present invention and being generally designated by reference numeral 10. The leak detecting apparatus 10 of this particular invention essentially facilitates the continuous and non-destructive testing of generally fluid-tight, sealed, and flexible packages 12, as such packages travel in a relatively rapid, non-interrupted succession along a first predetermined path 14. Such path 14 generally extends along the longitudinal extent of apparatus 10 and, as is to be described, is defined by the leak detecting apparatus 10. This preferred embodiment of leak detecting apparatus 10, is successful in reliably testing for leaks in packages 12 and is especially useful to ascertain whether or not such packages are properly or defectively sealed. Moreover, the leak detecting apparatus 10, as indicated above, appropriately tests for leaks in packages as they move along the first predetermined path 14 without otherwise damaging the package 12 or the contents contained therewithin.

Leak detecting apparatus 10, as will be subsequently described in greater detail, is adapted to test generally hermetically sealed packages 12 which contain cigarettes 16 or other similar types of rod-like tobacco products. Although the leak detecting apparatus 10 may be effectively used in conjunction with generally flexible and hermetically sealed cigarette packages 12 containing cigarettes 16 or the like, it should be mentioned, of course, that other types of relatively flexible and generally fluid-tight or hermetic sealed packages storing different kinds of articles and containing other types of fluids, such as inert gases or suitable liquids, can also be appropriately tested for leaks without damaging such packages or the articles stored thereby during testing.

Essentially hereinafter described, the in-line leak detecting apparatus 10, as envisioned by the present invention, basically includes first or conveying means 18, second or compressing means 20, and third or monitoring means 22.

Figure 3:
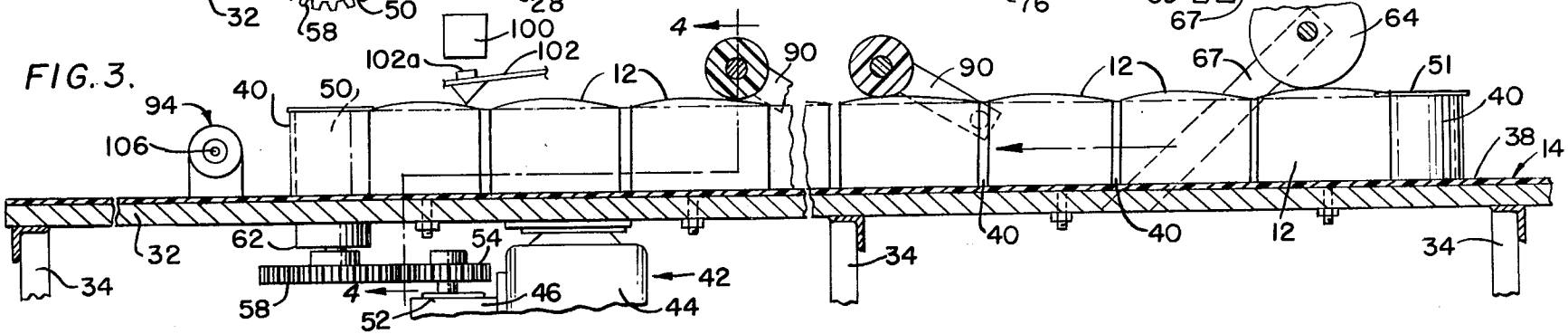
FIG. 3 is a sectional view taken substantially along the section line 3—3 appearing in FIG. 2 looking in the direction of the arrows and illustrating even greater detail of the novel and improved in-line leak detecting apparatus of the instant invention.
Figure 4:
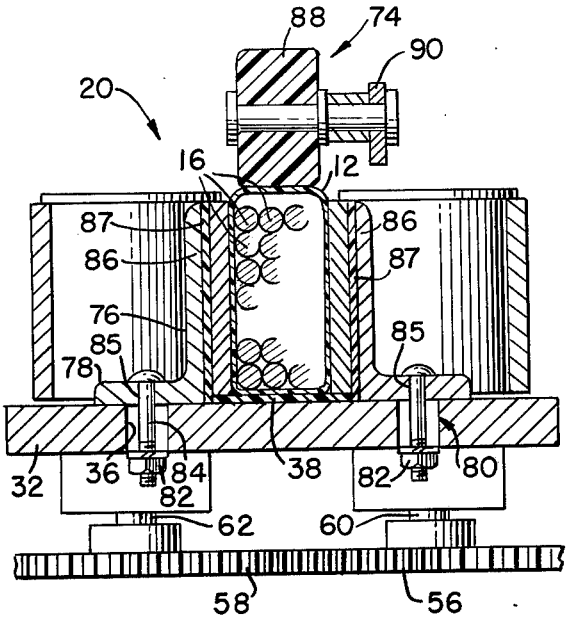
FIG. 4 is a sectional view taken substantially along section line 4—4 appearing in FIG. 3 looking in the direction of the arrows and illustrating a cigarette package which does not have a leak and which is acted upon in accordance with the principles of the present invention.
Figure 5:
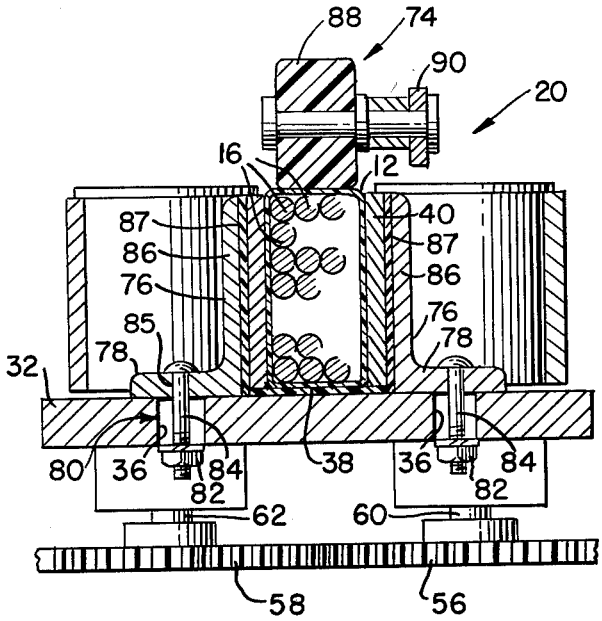
FIG. 5 is a sectional view similar to FIG. 4, but, however, illustrating a defective cigarette package being tested.

As specifically shown in FIGS. 1 to 5, the first conveying means is depicted as essentially including support means 24, base means 26, driving means 28, and leveling means 30. The support means 24 may be defined by a generally flat and horizontal support table member 32 which is supported by and appropriately connected to upright structural support members 34 to form a sturdy support frame. As best shown in FIGS. 4 and 5, taken in conjunction with FIG. 2, a plurality of elongated slots 36 are longitudinally spaced along opposite sides of the path 14 for purposes afterwards more fully discussed.

Base means 26 serves to define the generally longitudinally extending path 14 upon which packages 12 successively travel as they are to be tested. Basically, base means 26 comprises a generally longitudinally extending strip 38 of relatively low friction, non-stick, wear-resistant material which serves to facilitate advancement of the packages 12 along path 14 from the loading station A towards the monitoring and discharge stations B and C, respectively. The strip 38 is suitably connected in any appropriate fashion to the upper surface of the table member 32 as by a suitable adhesive tape or the like. Such strip 38 of material, as contemplated by the present invention, may be made from any suitable type of material which basically possesses non-stick and wear-resistant properties as well as has a relatively low coefficient of friction. In the present embodiment, strip 38 is fabricated from a Fluorglas material which is commercially available from Engineering Plastics Inc., Richmond, Virginia. Essentially, the material is comprised of Teflon having glass fibers embedded therein. Additionally, by having the packages 12 move along the strip material 38 as opposed to the metal surfaces, there is less of a likelihood that any printing ink on the packages will be rubbed off. It will be appreciated that the dimensions of strip material 38 have been somewhat exaggerated for purposes of clarity in illustration. Its width, for instance, may, of course, be varied in accordance with the width of packages to be advanced.

Turning now to driving means 28, continuous reference is made to FIGS. 1 to 4. Driving means 28 is seen to include a pair of conventionally constructed endless conveyor drive belts 40, and drive system means 42. The pair of endless conveyor belts 40 are in a generally upright position and are also spaced apart in generally parallel relation with respect to each other. Conveyor belts 40 are disposed along opposite sides of the strip member 38 for purposes of continuously advancing each of the packages 12 along path 14. As will be subsequently described, conveyor belts 40 operatively cooperate with the second or compressing means 20 so as to be movable away from and towards each other. The conveyor belts 40 whenever moved towards each other so as to be appropriately spaced apart by a predetermined distance are adapted to engage the opposite sides of the packages 12 for purposes of advancing the packages 12 from the loading station A towards the monitoring and discharge stations B and C, respectively. In addition, belts 40, in conjunction with the second or compressing means 20, further serve to guide the packages 12 as the latter travel along path 14. It will be understood that belts 40 are operatively mechanically driven, in a standard fashion, by the drive system means 42.

Drive system means 42 may be any suitable and conventional type necessary to drive the conveyor belts 40. Since the drive system means 42 is conventional only brief reference will be made to its construction and operation inasmuch as it does not form an aspect of the present invention. To understand its cooperation with the present invention the drive system means 42 comprises a suitable motive power source, such as a conventional electric motor 44 or the like, and connected thereto a known type of reducer mechanism 46. In addition, drive means 42 includes gear train arrangement 48 and conveyor pulleys 50 and 51.

The gear train arrangement 48 includes a drive shaft 52 which is appropriately driven by motor 44. It will be noted that the motor 44, reducer mechanism 46, and gear arrangement 48 are suitably connected to the support table member 32 in any suitable fashion. Attached to drive shaft 52 (FIG. 1) is driving gear 54, which is in meshing engagement with gear 56. Gear 56 is attached to the bottom of drive shaft 60 which drives a conveyor drive pulley 50 that has wrapped therearound one of the belts 40. The other end of the belt 40 is similarly wrapped about a rotatable pulley 51. This latter pulley 51 is mounted in an upstanding position with respect to the support table 32. Gear 58 is rotatably driven by gear 56 and, in turn, drives a second conveyor belt drive shaft 62 and corresponding drive pulley 50. It will be understood that the opposite or second rotatable pulley 51 similarly enables the other conveying belt 40 to be driven along the path 14.

By virtue of the above constructional arrangement, the conveying belts 40 are advanced in a manner such that they travel in the same direction, and, preferably, in synchronism with one another. Also, by having the belts 40 contact the sides of the packages 12 and advance therewith, there is less likelihood that any printed matter or the like on the side of the package will be rubbed off as might occur if there were relative movement between the packages and the conveyor belts.

As noted, the first or conveying means 18 also includes leveling means 30. In the present embodiment, leveling means 30 includes a rotatable leveling wheel 64 which is rotatably mounted on shaft member 66. The free ends of shaft member 66 are suitably attached to support table 32 through inclined support rods 67 or the like. The leveling wheel 64 primarily functions to ensure that individual packages 12 are oriented in a uniform plane so that they can be properly positioned for compressing and monitoring. Toward this particular end, leveling wheel 64 is positioned so that it strikes packages 12, after packages 12 have been directed onto the strip member 38 at the loading station A. In addition, leveling wheel 64 functions to force the packages towards and into engagement with strip member 38. In this particular manner, there is a greater likelihood that the packages will be in a proper position for the subsequent monitoring step to be performed. In addition, safety guards 69 are suitably connected to opposite sides of the support table 32, as more clearly shown in FIGS. 1 and 2, for preventing an operator from inadvertently contacting conveying belts 40.

In this particular embodiment, as shown in FIG. 1, there is situated adjacent the loading end A, a curved loading chute being designated by reference numeral 70 and depicted in phantom lines. Chute 70 is arranged to reorient the longitudinal axes of each of the packages 12 as they normally descend from a generally vertical position to a generally horizontal position. The loading chute 70 is particularly useful in those situations wherein, for instance, packages 12 vertically descend from a packaging machine (not shown) or the like. Although the loading chute 70 has been described for use in conjunction with in-line leak detecting apparatus 10, it will be understood, of course, that such leak detecting apparatus need not utilize the chute.

Specifically referring to FIGS. 2 to 5, there is more precisely depicted the second or compressing means 20. Compressing means 20 includes lateral compressing means 72 and vertical compression means 74. In regard to lateral compression means 72, it comprises a pair of longitudinally extending and substantially spaced apart and parallel generally L-shaped support brackets 76. Brackets 76 are relatively adjustably movable towards and away from each other for purposes subsequently made clear. Each support bracket 76 has a horizontal leg 78 mounted on support table 32. A plurality of conventional fastening means 80 including nuts 82 and bolts 84 cooperate with elongated slots 36 in support table 32 and aligned openings 85 in horizontal legs 78. In this manner, by unfastening the nuts 82 the bracket members 76, in well-known fashion, are able to be slidably movable relative to the support table 32 and strip member 38. The inwardly facing surfaces of vertical legs 86 of bracket members 76 have attached thereto a strip member 87 of low friction material which may, preferably, be made of the same Fluorglas material as strip 38 for purposes of enhancing movement of the conveyor belts 40 theralong. Such non-stick, low friction, and wear-resistant material will serve to minimize any additional work for the motor 44 as well as facilitate rapid movement of conveyor belts 40.

Figure 6:
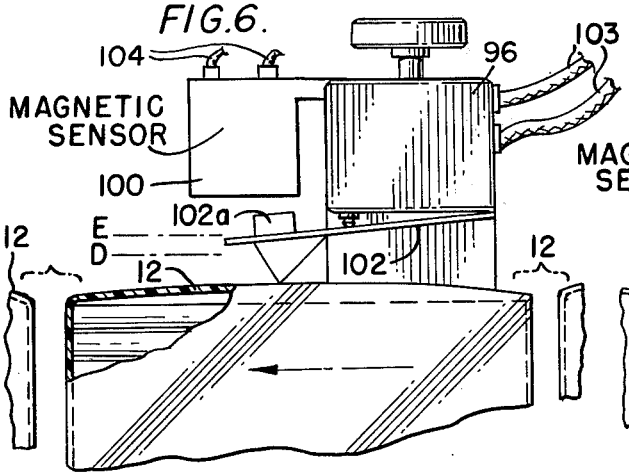
FIG. 6 is an enlarged schematic side elevational view illustrating the cooperation between a good package and a micro switch of the monitoring means of this invention located at the monitoring station of the in-line leak detecting apparatus.

In normal operation of apparatus 10, the brackets 76 will be advanced to a position whereat the distance separating them will be sufficient to compress the packages 12 to the extent that they swell or puff-up, much as in the manner indicated in FIGS. 4 and 6. As noted therein, the degree of puffing or swelling has been somewhat exaggerated for sake of illustration. Since both sides of the packages 12 are compressed inwardly by bracket members 76 and the bottoms thereof are normally resting upon the strip member 38 the swelling or puffing generally occurs in those directions in which the sides of the packages are not restrained. In practice, packages predominantly swell upwardly. It has been determined that the packages 12 without leaks generally swell by a certain amount which is greater than those packages which possess leaks. Those packages 12 which have leaks, however, expand very slight if at all. As will be subsequently made evident in the subsequent description, this differential in puffing after both vertical and horizontal compressing facilitates detection of good and bad packages by enabling proper placement of the monitoring means 22.

Figure 7:
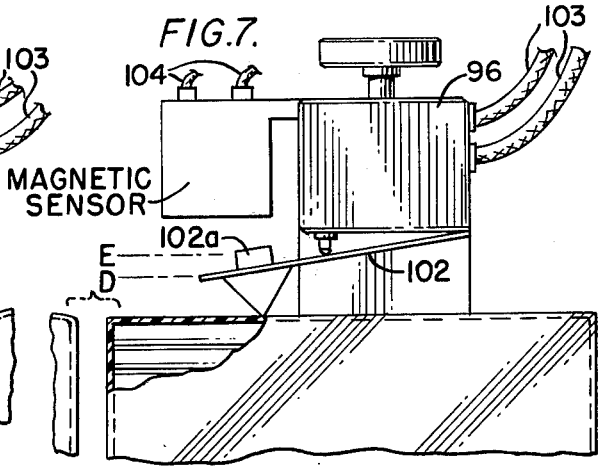
FIG. 7 is an enlarged schematic side elevational view illustrating the cooperation between the micro switch at the monitoring station with a defective package.

In regard to vertical compression means 74, it basically comprises a plurality of longitudinally spaced compressing rollers 88. These rollers 88 essentially serve to contact the tops of passing expanded packages 12 and as a result compress these top portions for purposes of forcing the air therefrom if such packages have leaks such as best shown in FIGS. 5 and 7. Should packages not possess leaks, vertical compression rollers 88 will be unable to force the air therefrom. As a result, these packages 12 remain expanded, see FIGS. 4 and 6. Accordingly, such continued expansion would indicate that the packages, as well as any seals thereof, are satisfactory. Towards this end, each of the rollers 88 is rotatably mounted at the end of respective inclined roller support members 90 which support members at the opposite ends thereof are fixedly attached at longitudinal intervals to one of the bracket members 76. The support members 90 are so arranged that they vertically position the rollers 88 such that the rollers form an obstruction for the packages and effect the aforenoted desired contact between the rollers 88 and the inflated tops of packages 12. It being understood that by having rollers 88, passage of the packages 12 is facilitated. Additionally, rollers 88 tend to downwardly force each of the packages 12 towards the strip member 38. In this manner, compressing rollers 88 generally overcome any tendency for packages 12 to migrate upwardly during their advancement along path 14. By preventing this upward migration packages 12 will be in proper position at monitoring station B for enabling accurate testing thereof in a manner to be described presently.

Referring in particular to FIGS. 2 and 3, third or monitoring means to be described is basically of the general category of sorting devices which effectively enable the sorting of good from bad packages. Although the present invention envisions an automatic sorting device whereby the necessity of a worker being continually used at the monitoring station is eliminated, it will be understood that it is within the spirit and scope of this invention that other types of conventional sorting devices, known in the art, may be utilized. For instance, a micro switch could be used at the sensing station to indicate the presence of a good package. In this particular situation, an operator would then be able to identify and withdraw defective packages from a continuously moving succession of packages.

Monitoring means 22 is located at the monitoring station B for purposes of enabling testing of all the packages 12. Monitoring means 22 may be the type commercially available from Angar Scientific Corporation of Roseland, New Jersey. Therefore, a detailed description as to its particular construction and operation will be dispensed with. However, to understand its basic operation a brief description of its construction and operation will be presently given in conjunction with the present invention. Basically, monitoring means 22 includes monitoring assembly 92 and ejecting means 94. The ejecting means 94 is operatively connected to support table 32. Also it is connected to the monitoring assembly by leads 95 for selective actuation by the latter. In the embodiment being illustrated, the monitoring assembly 92 includes micro switch 96, memory circuit means 98, and magnetic sensor or initiator 100. The switch 96 is a suitable type of micro switch which is connected in any convenient manner to the support table 32 and has a switch arm 102 with a pick-up button 102*a* positioned such that it is normally in the path of movement of each of the successively advancing packages 12. Moreover, switch 96 is connected by lead wires 103 to memory means 98. The magnetic sensor 100 is diagrammatically depicted in FIGS. 6 and 7 and is operatively associated with the switch arm 102 in appropriate fashion, as well as to support table 32. The magnetic sensor 100 is electrically connected to the memory means 98 by lead wires 104.

As noted, switch arm 102 is normally positioned such that it depends into the path of movement of the successively advancing packages 12 wherein every package 12 which makes contact therwith, at least moves the switch upwardly to about the level D, indicated by phantom lines in FIG. 7. As a result, and in a conventional manner, a magnetic field is created, and a thusly generated signal is transmitted to the memory means 98, such as in the manner of a clock pulse so as to indicate the presence of a package 12. As a consequence thereof, each of the packages 12 advanced along path 14 will be detected through the cooperation of the switch arm 102 and magnetic sensor 100. Whenever a good or non-defective package 12 contacts switch arm 102, it will force the latter upwardly to about the level indicated by phantom line E as indicated in FIG. 6. In this particular fashion, switch 96 is in an open condition and serves to, in a known fashion, generate a signal to the memory means 98 that the package is good. Memory means 98 will, in a conventional manner, function to keep track of not only all the packages, but also all the good and bad packages as well.

Should a defective package, as indicated in FIGS. 5 and 7, be sensed, a signal is generated which is appropriately handled, in a known manner, by a memory means 98 to keep track of the packages as they continue movement along path 14. If a bad package is tested the memory means 98 basically will generate an output pulse after a selected time delay to ejecting means 94. This output pulse is transmitted such that whenever a particular defective package has been tested by the micro switch 96 and sensor 100 and such package is then opposite ejecting means 94, the output pulse will be effective to actuate the ejecting means 94. Good packages will respectively cooperate with the micro switch 96 and memory means 98 in a standard fashion to the extent that ejecting means 94 will not be actuated so as to eject the corresponding good packages whenever adjacent the ejecting means 94. Ejecting means 94 of this particular invention is a conventional form of pneumatic valve operated device which serves to selectively emit pressurized air from nozzle 106 in response to actuation by the memory means 98. Accordingly, upon receiving an appropriate output pulse from the memory means 98 indicating that a bad package had been previously detected by the micro switch 96 and sensor 100 such signal will actuate the ejection means 94. As a result a stream of pressurized air is directed across path 14. This stream of pressurized air or the like, will be sufficient to force the appropriate defective package 12 from path 14 into a suitable receptacle or the like (not shown). Consequently, packages 12 which have been properly sealed and do not possess leaks will pass uninterruptedly towards the discharge end C. Those packages having leaks will be ejected in a manner which avoids interruption of the continuous advancement of the packages.

After having thus described the aforenoted constructional arrangement of the present invention, it is believed that the operation thereof is self-evident from the foregoing description.

To briefly describe the operation, however, it will be appreciated that the fluid-tight packages 12 are continuously advanced by belts 40 along path 14. Lateral compression of the packages 12 is effectuated by brackets 76. As the packages 12 are advanced, those packages which do not have leaks will expand by virtue of trapped air. The packages which do have leaks will slightly expand or not expand at all. The vertical compression rollers 88 serve to aid the expulsion of the air within the package 12 for facilitating the deflation of leaking packages. Monitoring means 22 automatically separates the good packages from the bad packages in response to whether or not such packages have remained inflated.

As can be appreciated from the foregoing description, in-line leak detecting apparatus 10 is a relatively simple and economical apparatus which continuously and non-destructively tests for leaks in generally fluid-tight, flexible packages without interrupting the normal rapid movement of such packages in a production line assembly, or damaging either the packages or the contents stored in the packages. Additionally, the foregoing described in-line leak detecting apparatus is simple in construction and use, yet is accurate in determining the presence of leaks in generally fluid-tight sealed packages.

While the invention has been described in connection with a preferred embodiment, it is not intended to limit the invention to the particular form set forth above, but, on the contrary, it is intended to cover such alternatives, modificatons, and equivalents as may be included within the spirit and scope of the invention as defined by the appended claims.

What is claimed is:

1. An apparatus for use in continuously testing for leaks in a plurality of generally fluid-tight and flexible packages which are conveyed along a predetermined path comprising first means for continuously conveying a plurality of the packages along the predetermined path, second means operatively connected to the first means for applying compressive forces for compressing the generally fluid-tight packages as they are continuously conveyed along the predetermined path to the extent that those packages which do not have leaks expand in directions which are free from compressive forces by at least a predetermined amount and whereas those packages which have leaks will not expand by the predetermined amount, and third means being operatively connected to said second means for at least monitoring the existence of the predetermined expanded packages by cooperating with the predetermined expanded portions of the packages as the packages are continuously advanced to thereby enable defective leaking packages to be removed.

2. An apparatus as set forth in claim 1 in which said third means automatically ejects those packages from said predetermined path which did not expand by the predetermined amount in response to the compression by said second means.

3. An apparatus for use in the continuous and non-destructive testing for leaks in a plurality of generally fluid-tight and flexible packages having contents therein which are conveyed along a predetermined path comprising first means for continuously conveying a plurality of the packages along the predetermined path, second means operatively connected to the first means for compressing the packages so that the packages expand in uncompressed directions and for at least intermittently compressing segments of the expanded portions of the generally fluid-tight packages as they are continuously conveyed along the predetermined path to the extent that those packages which do not have leaks expand by at least a predetermined amount without damaging the package or the contents contained within the packages, and whereas those packages which have leaks will not expand by the predetermined amount, and third means being operatively connected to said second means for monitoring the existence of the predetermined expanded packages by cooperating with the predetermined expanded portions as the packages are continuously advanced for enabling selective withdrawal of the leaking packages.

4. An apparatus as set forth in claim 3 in which said third means automatically ejects those packages from said predetermined path which did not expand by the predetermined amount in response to the compression by said second means.

5. An apparatus as set forth in claim 3 in which said first means includes support means, base means supported by said support means for facilitating advancement of the packages in said path, and driving means connected to said support means for conveying the packages on said base means along said path.

6. An apparatus as set forth in claim 5 in which said support means includes a generally elongated support table.

7. An apparatus as set forth in claim 6 in which said base means is comprised of a generally elongated strip of low friction, non-stick, and wear-resistant material being placed on a top surface of said support table.

8. An apparatus for use in continuously testing for leaks in a plurality of generally air-tight and flexible packages which are conveyed along a predetermined path comprising first means for continuously conveying a plurality of the packages along the predetermined path, said first means includes support means, base means supported by said support means for faciliating advancement of the packages in said path, driving means connected to said support means for conveying the packages on said base means along said path, said support means includes a generally elongated support table, said base means is comprised of a generally elongated strip of non-stick, wear-resistant, and low friction material being placed on a top surface of said support table, said driving means includes a pair of spaced apart and generally parallel conveying belts, each of which is disposed on opposite sides of said base means for advancing the packages along said path, said first means further includes leveling means connected to said support means for leveling the packages which are loaded onto said base means such that they are in a uniform plane, and for tending to force each package downwardly toward said base means to avoid any tendency of upward package migration; second means operatively connected to the first means for compressing the generally air-tight packages as they are continuously conveyed along the predetermined path to the extent that those packages which do not have leaks expand by at least a predetermined amount and whereas those packages which have leaks will not expand by the predetermined amount, said second means includes lateral compression means for laterally compressing the packages as the packages move along said path for expanding those packages which do not have leaks by a predetermined amount and for enabling the forcing out of air or the like in the package, such that those packages which have leaks will expand slightly or not at all, and vertical compression means for vertically compressing the packages as the packages move along said path for enabling deflation of those packages which have leaks, said lateral compression means includes a pair of spaced apart adjustable support members, each of which is on opposite sides of said base means, and each of which is adjustably connected to said support means for selectively accommodating packages of different dimensions therebetween and for squeezing the packages to cause the expansion of the flexible material of the packages by trapped air, said vertical compression means includes a plurality of rotatable rollers which are spaced at longitudinal intervals with respect to each other and are operatively connected to the support table for contacting the top portions of the packages as they are conveyed along said predetermined path; and third means being operatively connected to said second means for monitoring the existance of the predetermined expanded packages as the packages are continuously advanced, and for automatically ejecting those packages from said predetermined path which did not expand by the predetermined amount in response to the compression by said second means.

9. A method for continuously testing for leaks in generally fluid-tight and flexible packages comprising the steps of continuously advancing the packages along a predetermined path, compressing the packages as they are successively advanced along the predetermined path such that those packages which do not have leaks expand by at least a predetermined amount, and whereas those packages which have leaks will not expand by the predetermined amount, and monitoring the predetermined expanded portions of the packages to determine at least which packages do not have leaks so as to enable removal of the defective or leaking packages.

10. A method for continuously and non-destructively testing for leaks in generally fluid-tight packages comprising the steps of continuously advancing the package along a predetermined path, laterally compressing the packages as they are advanced such that those packages not having leaks will expand by virtue of trapped fluid and those packages which do leak will slightly expand or not expand at all by virtue of trapped fluid being forced out such that neither the packages nor the contents thereof are damaged, vertically compressing the expanded portions of the packages for facilitating the deflation of the expanded packages without damaging either the package or the contents thereof, and separating the good packages from the bad packages in response to whether such packages have remained expanded by at least a predetermined amount after being laterally and vertically compressed.

11. An apparatus for use in the continuous and non-destructive testing for leaks in a plurality of generally fluid-tight and flexible packages which are conveyed along a predetermined path comprising first means for continuously conveying a plurality of the packages along the predetermined path, second means operatively connected to the first means for compressing the generally fluid-tight packages as they are continuously conveyed along the predetermined path to the extent that those packages which do not have leaks expand by at least a predetermined amount without damaging the package or the contents contained within the packages, and whereas those packages which have leaks will not expand by the predetermined amount, and third means being operatively connected to said second means for monitoring the existence of the predetermined expanded packages as the packages are continuously advanced, said first means includes support means, base means supported by said support means for facilitating advancement of the packages in said path, and driving means connected to said support means for conveying the packages on said base means along said path, and said driving means includes a pair of spaced apart and generally parallel conveying belts, each of which is disposed on opposite sides of said base means for advancing the packages along said path.

12. An apparatus for use in the continuous and non-destructive testing for leaks in a plurality of generally fluid-tight and flexible packages which are conveyed along a predetermined path comprising first means for continuously conveying a plurality of the packages along the predetermined path, second means operatively connected to the first means for compressing the generally fluid-tight packages as they are continuously conveyed along the predetermined path to the extent that those packages which do not have leaks expand by at least a predetermined amount without damaging the package or the contents contained within the packages, and whereas those packages which have leaks will not expand by the predetermined amount, and third means being operatively connected to said second means for monitoring the existence of the predetermined expanded packages as the packages are continuously advanced, said third means automatically ejects those packages from said predetermined path which did not expand by the predetermined amount in response to the compression by said second means, said second means includes lateral compression means for laterally compressing the packages as the packages move along said path for expanding those packages which do not have leaks by a predetermined amount and for enabling the expulsion of fluid from the packages which have leaks such that the leaking packages will expand slightly or not at all, and vertical compression means for vertically compressing the packages as the packages move along the said path for enabling deflation of packages which have leaks.

13. An apparatus as set forth in claim 12 in which said lateral compression means includes a pair of spaced apart adjustable support members, each of which is on opposite sides of said base means, and each of which is adjustably connected to said support means for selectively accommodating packages of different dimensions therebetween and for squeezing the packages to cause the expansion of the flexible material of the packages by trapped fluid or the like.

14. An apparatus as set forth in claim 12 in which said vertical compression means includes a plurality of rotatable rollers which are spaced at longitudinal intervals with respect to each other and are operatively connected to the support table for contacting the top portions of the packages as they are conveyed along said predetermined path.

15. An apparatus for use in the continuous and non-destructive testing for leaks in a plurality of generally fluid-tight and flexible packages which are conveyed along a predetermined path comprising first means for continuously conveying a plurality of the packages along the predetermined path, second means operatively connected to the first means for compressing the generally fluid-tight packages as they are continuously conveyed along the predetermined path to the extent that those packages which do not have leaks expand by at least a predetermined amount without damaging the package or the contents contained within the packages, and whereas those packages which have leaks will not expand by the predetermined amount, and third means being operatively connected to said second means for monitoring the existence of the predetermined expanded packages as the packages are continuously advanced, said first means includes support means, base means supported by said support means for facilitating advancement of the packages in said path, and driving means connected to said support means for conveying the packages on said base means along said path, said first means includes leveling means connected to said support means for leveling the packages which are loaded onto said base means such that they are in a substantially uniform plane, and for forcing each package downwardly toward said base means.

* * * * *